US008707471B2

(12) United States Patent
Chen

(10) Patent No.: US 8,707,471 B2
(45) **Date of Patent: *Apr. 29, 2014**

(54) NOSE-SHIELDING DEVICE FOR HELMET

(71) Applicant: Tsan-Jee Chen, Taipei (TW)

(72) Inventor: Tsan-Jee Chen, Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 13/777,545

(22) Filed: Feb. 26, 2013

(65) Prior Publication Data

US 2013/0174313 A1 Jul. 11, 2013

Related U.S. Application Data

(63) Continuation-in-part of application No. 13/084,671, filed on Apr. 12, 2011, now Pat. No. 8,407,819.

(30) Foreign Application Priority Data

Mar. 13, 2012 (TW) ..... 101204517 U

(51) Int. Cl.
*A42B 1/08* (2006.01)

(52) U.S. Cl.
USPC ..... 2/424

(58) Field of Classification Search
USPC ..... 2/410, 422, 424, 425, 171.3, 171.4, 2/436, 437, 9
See application file for complete search history.

(56) References Cited

U.S. PATENT DOCUMENTS

| | | | | |
|---|---|---|---|---|
| 3,311,922 | A * | 4/1967 | Bezzerides | 2/8.1 |
| 5,797,146 | A * | 8/1998 | Matich | 2/424 |
| 6,644,308 | B2 * | 11/2003 | Kalhok et al. | 128/201.24 |
| 6,742,192 | B1 * | 6/2004 | Song | 2/422 |
| 8,407,819 | B2 * | 4/2013 | Chen | 2/424 |

* cited by examiner

*Primary Examiner* — Tejash Patel
(74) *Attorney, Agent, or Firm* — Ming Chow; Sinorica, LLC

(57) ABSTRACT

An improved nose-shielding device comprises: a nose-shielding body, which has a nose-shielding surface and a positioning surface that are about perpendicular to each other, a nose-shielding portion is located around the central of the nose-shielding surface and protruded upward, a nose-shielding room is formed accordingly inside the nose-shielding portion, a nose-touching portion is formed at the bottom surface of the nose-shielding portion, an adjusting room is formed between the nose-touching portion and the bottom surface of the nose-shielding portion, and the improved nose-shielding device is characterized in that: the nose-shielding portion has a flexible folded member that integrates with a portion, corresponding to the bridge of an operator nose, of the nose-shielding portion, and is adjustable for the folding degree of the folded member according to the figure of the bridge of the operator nose, thus the nose-shielding body more fits the operator nose.

5 Claims, 8 Drawing Sheets

NOSE-SHIELDING DEVICE FOR HELMET

This application is a Continuation in-part of U.S. patent application Ser. No. 13/084,671 filed on Apr. 12, 2011. The current application also claims a foreign priority to the patent application of Taiwan No. 101204517 filed on Mar. 13, 2012.

BACKGROUND OF THE INVENTION

1. Field of the Invention

The present invention generally relates to an improved nose-shielding device for helmet, more particularly to a nose-shielding device that has a flexible folded member integrated with a nose-shielding body and is adjustable for the touching degree of the bridge of the nose of each operator.

2. Description of the Prior Art

The present applicant applied a utility model patent,

No. M413363U1, in Taiwan, Republic of China, and the title is nose-shielding device for helmet. The nose-shielding device comprises a nose-shielding body that is made integrally, a nose-shielding portion is located around the central of the nose-shielding body and protruded, a nose-shielding room is formed accordingly inside the nose-shielding portion, the front edge of the nose-shielding body elongates upwardly to form a positioning surface, in addition, the rear edges of the nose-shielding body and the nose-shielding portion elongate backward and bent inwardly, a nose-touching portion forms inside a nose-shielding room, the nose-shielding body integrates with the inner portion of the helmet and locates below a mask of the helmet, while the operator wears the helmet, and the nose is accommodated in the nose-shielding room, further that the bridge of the nose of the operator fits the nose-touching portion, so that the nose-shielding body and the nose tightly touch to each other, and the warm air discharged from the nose or mouth of the operator may not go up, and the mask of the helmet is not nebulized, so as to approach the safety of riding bicycle.

Due to the nose-shielding body being made of rubber and plastic material and structural restriction, only the nose-touching portion slightly touches onto the bridge of the nose of the operator, although the material is elastic. As a matter of fact, is the applicant found that everybody has the shape of the nose oneself, for instance, if the bridge is too narrow, the nose-touching portion cannot completely fit the bridge of the nose of the operator, in addition, the shortcoming lets the noses of partial operators be pressed while using it. Therefore, providing an improved nose-shielding device for helmet that has a flexible folded member integrated with the nose-shielding body and is adjustable for the touching degree of the nose-shielding body and the bridge of the nose of each operator shall be the best solution.

SUMMARY OF THE INVENTION

The main objective of the present invention is to provide an improved nose-shielding device for helmet in order to let the nose-shielding device fit each operator.

To approach aforesaid objectives, the improved nose-shielding device comprises: a nose-shielding body, which has a nose-shielding surface and a positioning surface that are about perpendicular to each other, a nose-shielding portion is located around the central of the nose-shielding surface and protruded upward, a nose-shielding room is formed accordingly inside the nose-shielding portion, a nose-touching portion is formed at the bottom surface of the nose-shielding portion, an adjusting room is formed between the nose-touching portion and the bottom surface of the nose-shielding portion, and the improved nose-shielding device is characterized in that: the nose-shielding portion has a flexible folded member that integrates with a portion, is corresponding to the bridge of an operator nose, of the nose-shielding portion, and is adjustable for the folding degree of the folded member according to the figure of the bridge of the operator nose, thus the nose-shielding body more fits the operator nose.

In practice, the folded member integrates with the surface, corresponding to the bridge of the operator, of the nose-shielding portion by means of integrative shaping.

In practice, the folded member integrates with the inner surface, corresponding to the bridge of the operator, of the nose-shielding portion by means of integrative shaping.

In practice, the folded member integrates with the bottom surface, corresponding to the bridge of the operator, of the nose-shielding portion by means of integrative shaping. In practice, the folded member is made of metal.

Other and further features, advantages, and benefits of the invention will become apparent in the following description taken in conjunction with the following drawings. It is to be understood that the foregoing general description and following detailed description are exemplary and explanatory but are not to be restrictive of the invention. The accompanying drawings are incorporated in and constitute a part of this application and, together with the description, serve to explain the principles of the invention in general terms. Like numerals refer to like parts throughout the disclosure.

BRIEF DESCRIPTION OF THE DRAWINGS

The objects, spirits, and advantages of the preferred embodiments of the present invention will be readily understood by the accompanying drawings and detailed descriptions, wherein.

DETAILED DESCRIPTION OF THE INVENTION

Figure 1:
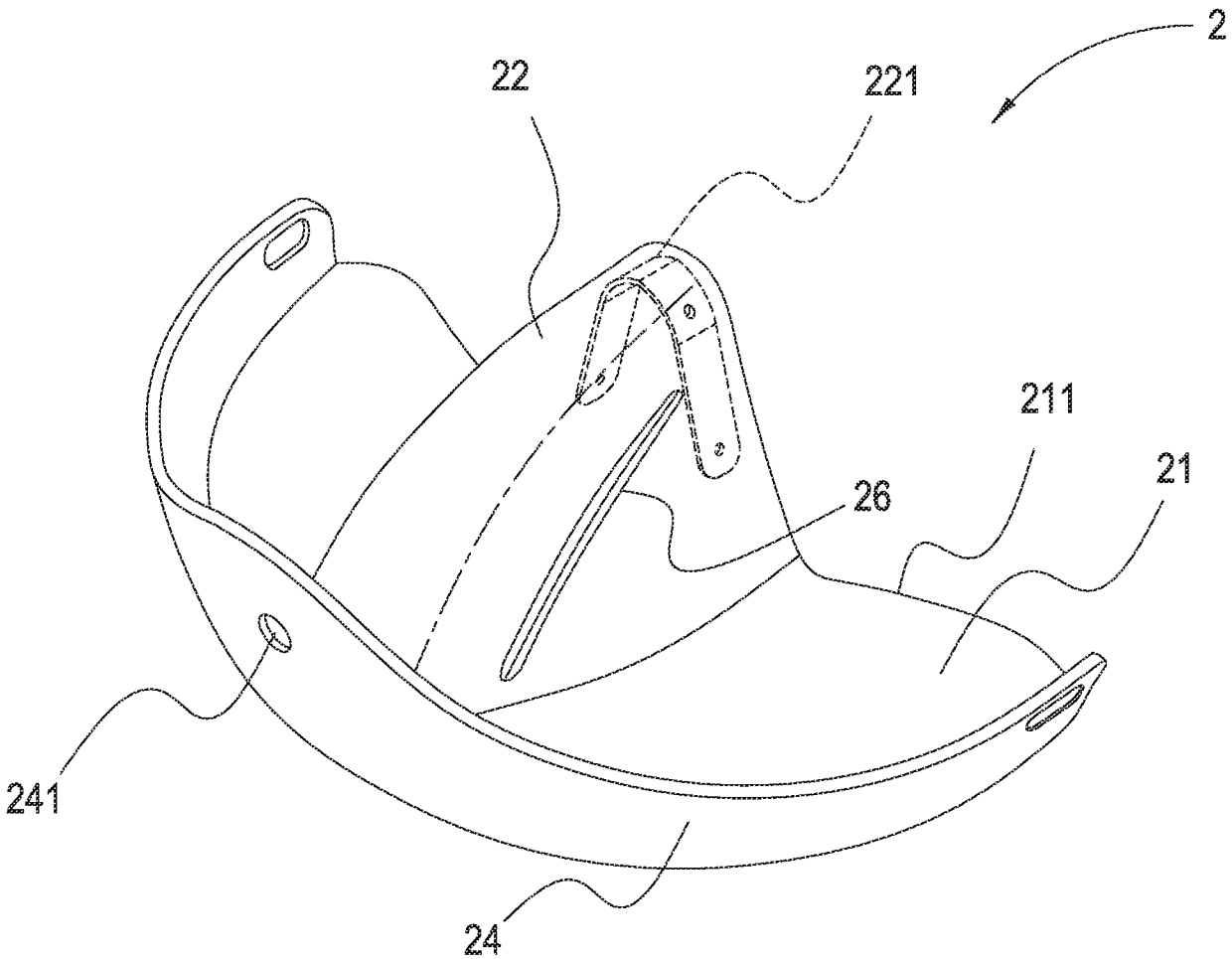
FIG. 1 illustrates schematic 3-D structural views of the improved nose-shielding device for helmet of the present invention.
Figure 2:
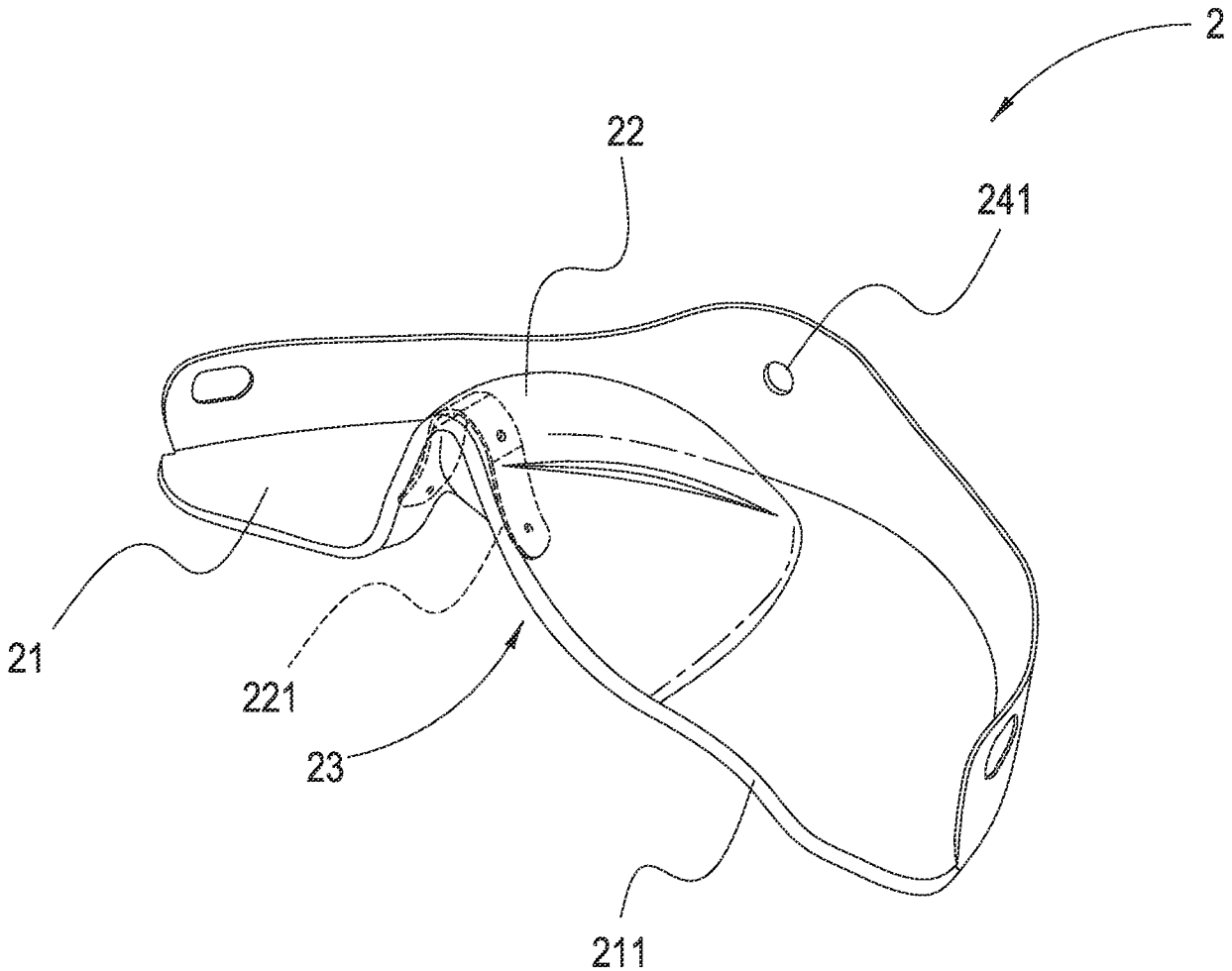
FIG. 2 illustrates schematic 3-D structural views of the improved nose-shielding device for helmet of the present invention.

Following preferred embodiments and figures will be described in detail so as to achieve aforesaid objects.

With references to FIG. 1, FIG. 2, FIG. 3, and FIG. 4, is which illustrate two schematic 3-D structural views of the improved nose-shielding device for helmet of the present invention, a schematic sectional view of the nose-shielding device for helmet of the present invention and a schematic lateral view of the nose-shielding device for helmet of the present invention. The nose-shielding device includes:

a nose-shielding body 2, which is made by means of integrative shaping and has a nose-shielding surface 21 and a positioning surface 24 that has at least one positioning hole 241, the nose-shielding surface 21 and the positioning surface 24 are about perpendicular to each other, a nose-shielding portion 22 is located around the central of the nose-shielding surface 21 and protruded upward, a nose-shielding room 23 is formed accordingly inside the nose-shielding portion 22, wherein the other side edge 211, without the positioning surface 24, of the nose-shielding surface 21 is elongated backward and bent inwardly to form a fold sheet 27, the fold sheet 27 covers the nose-shielding portion 22, so that the inner of the nose-shielding room 23 is formed a nose-touching portion 25, the nose-touching portion 25 cannot fit the bottom surface of the nose-shielding portion 22 since the nose-shielding portion 22 is a streamline arc surface, thus a distance is between the nose-touching portion 25 and the bottom surface of the nose-shielding portion 22, and therefore an adjusting room 28 is formed between the nose-touching portion 25 and the bottom surface of the nose-shielding portion 22;

the nose-shielding surface 21 and the positioning surface 24 are semi-arc surfaces. The side surface of the nose-shielding portion 22 is a streamline arc surface that is similar to the figure of a nose in order to fit the bridge 411 of the nose 41 of an operator. The each side surface of the nose-shielding portion 22 has a groove 26 in order to fit the each nosewing of the nose 41 of the operator.

Figure 3:
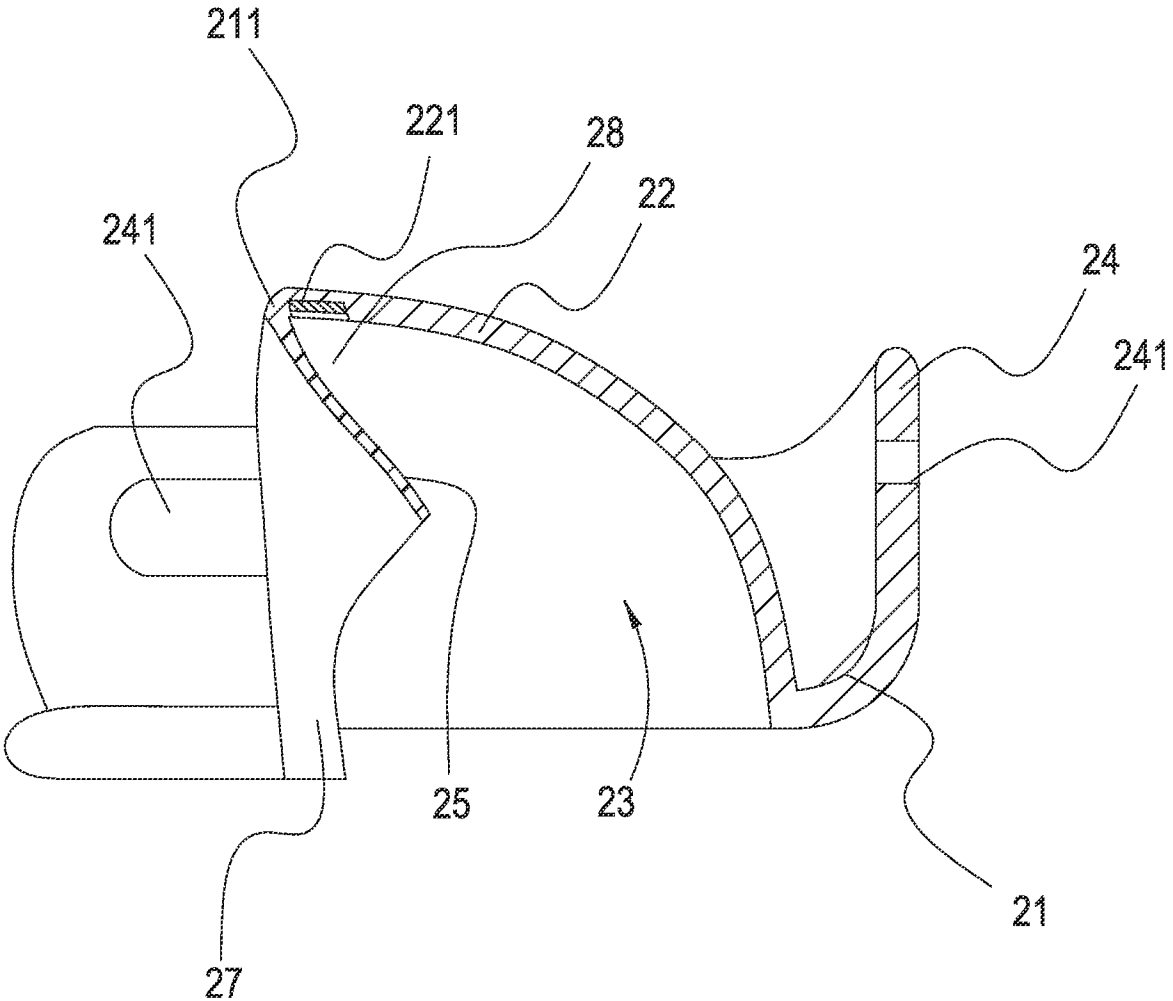
FIG. 3 illustrates a schematic sectional view of the nose-shielding device for helmet of the present invention.
Figure 4:
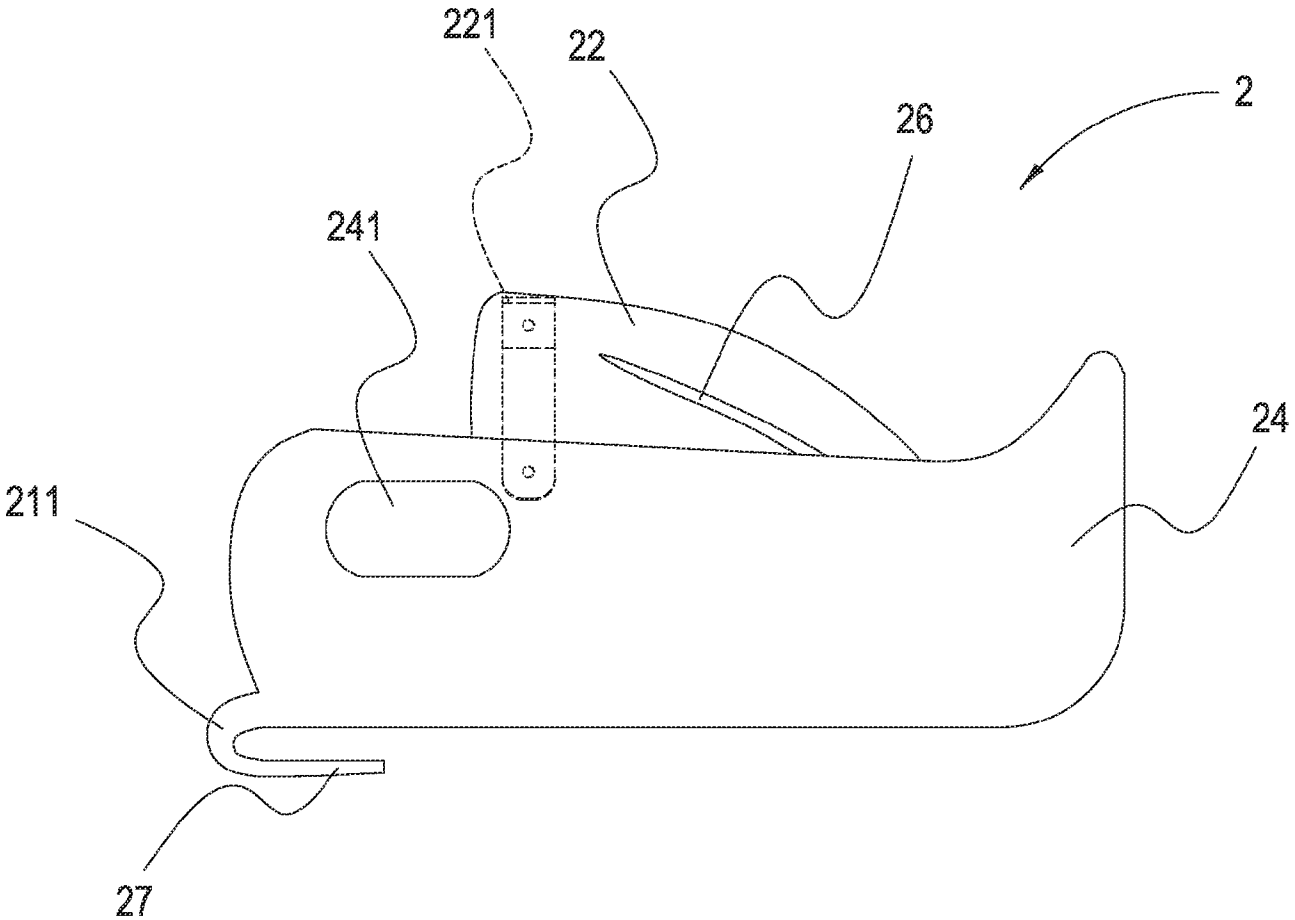
FIG. 4 illustrates a schematic lateral view of the nose-shielding device for helmet of the present invention.

As shown in FIG. 3, the nose-shielding portion 22 has a flexible folded member 221 that integrates with the inner surface, corresponding to the bridge 411 of the operator nose 41, of the nose-shielding portion 22, and is adjustable for the folding degree of the folded member 221 according to the figure of the bridge 411 of the operator nose 41, thus the nose-shielding body (2) fits each operator.

Further, in addition to the internal surface of the nose-shielding portion 22, the folded member 221 integrates with the surface, corresponding to the bridge 411 of the nose 41 of the operator 4, of the nose-shielding portion 22 by means of integrative shaping, or the folded member 221 integrates with the bottom surface, corresponding to the bridge 411 of the operator 4, of the nose-shielding portion 22 by means of integrative shaping.

More, the folded member 221 is made of metal, the nose-shielding portion 22 and the nose-touching portion 25 are able to position the bridge 411 of the nose 41 of the operator 4 while the folding degree of the folded member 221 is adjusted according to the figure of the bridge 411 of the nose 41.

Figure 5A:
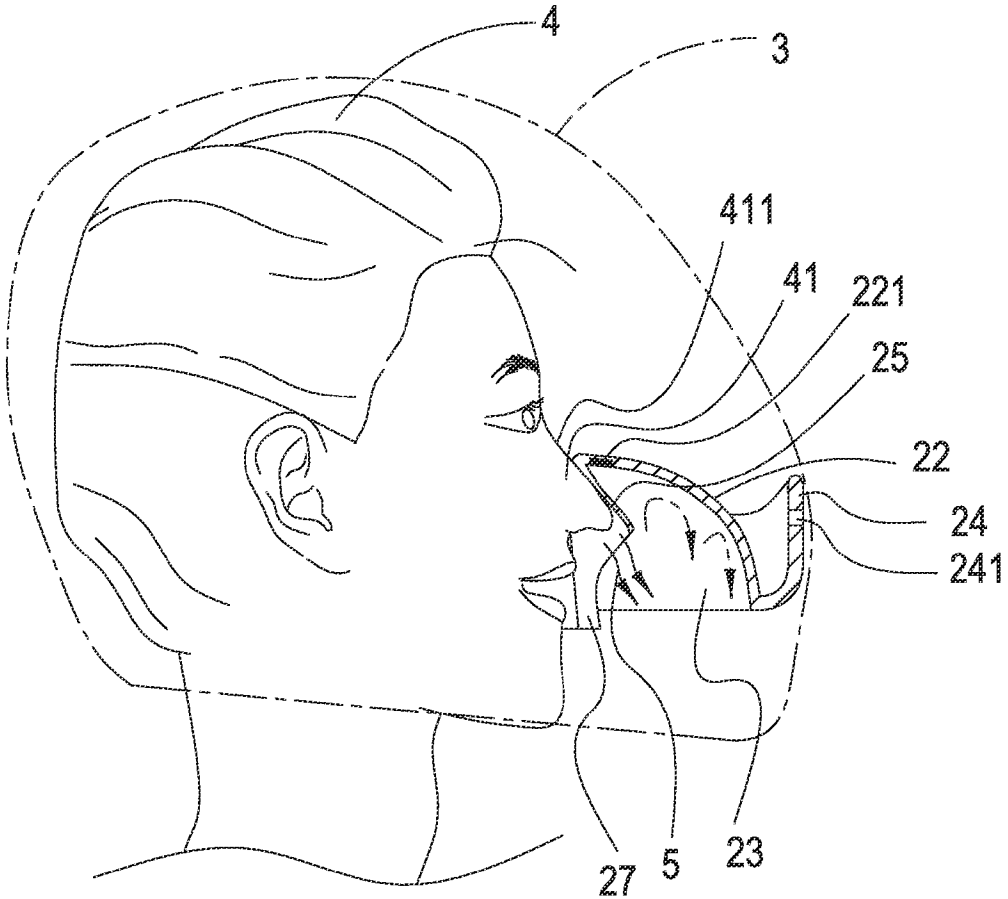
FIG. 5A illustrates a schematic combining view of the improved nose-shielding device and the helmet of the present invention.
Figure 5B:
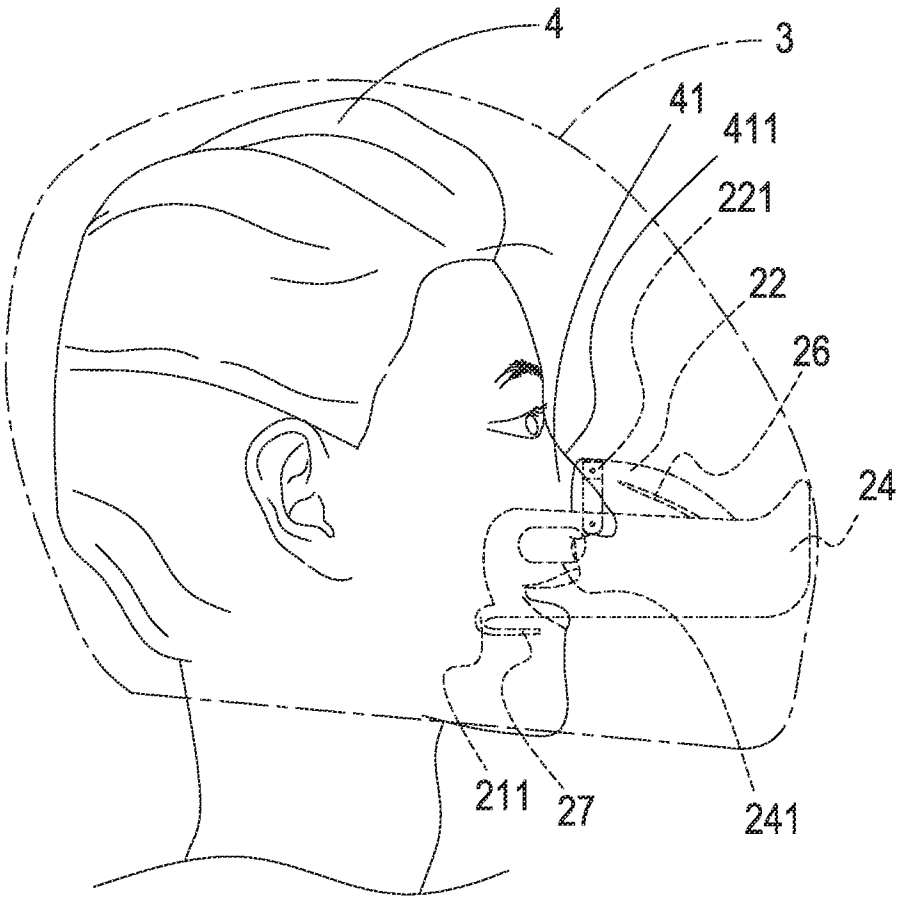
FIG. 5B illustrates a schematic combining view of the improved nose-shielding device and the helmet of the present invention
Figure 6A:
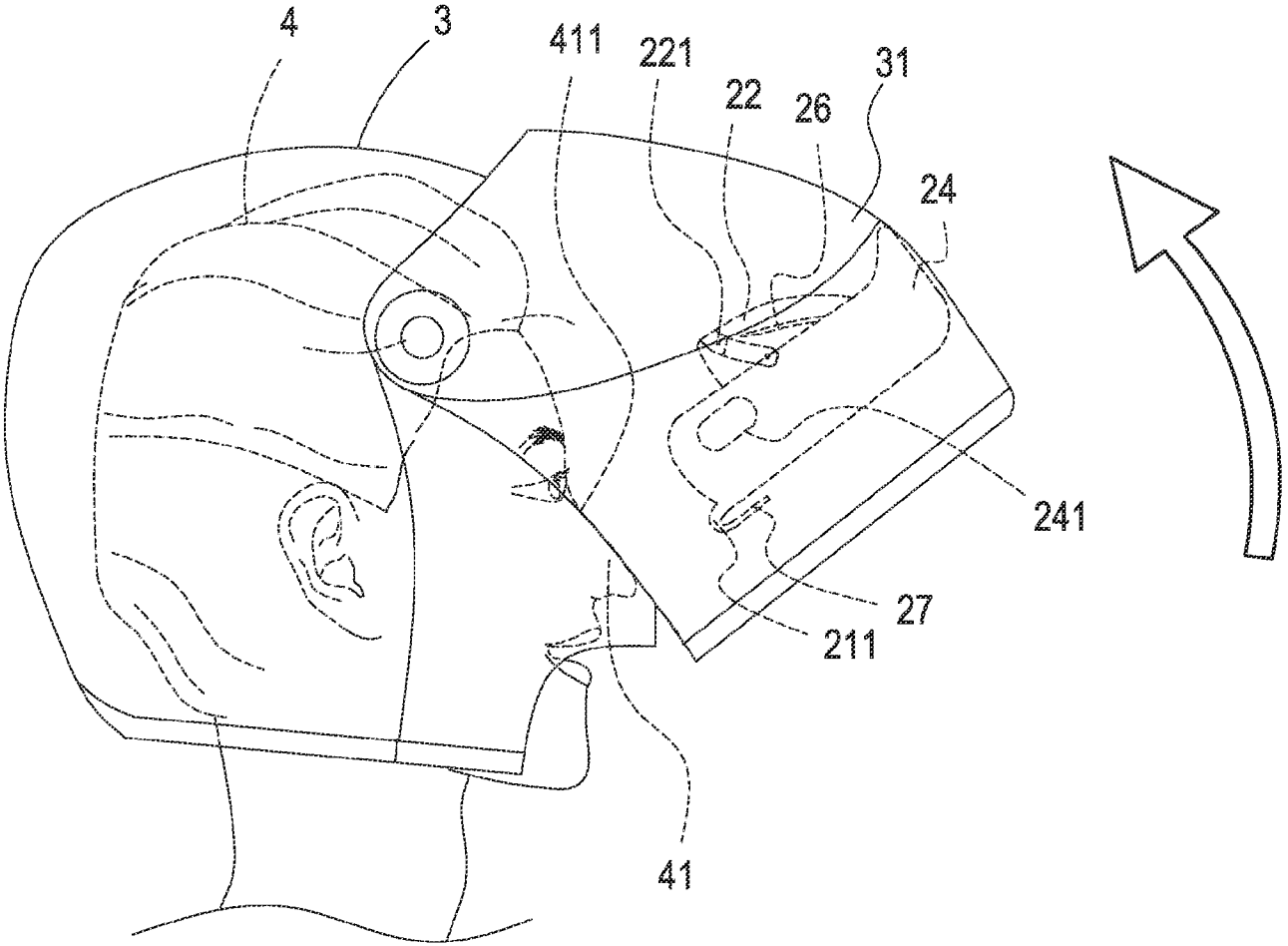
FIG. 6A illustrates a schematic application view of the improved nose-shielding device of the present invention.
Figure 6B:
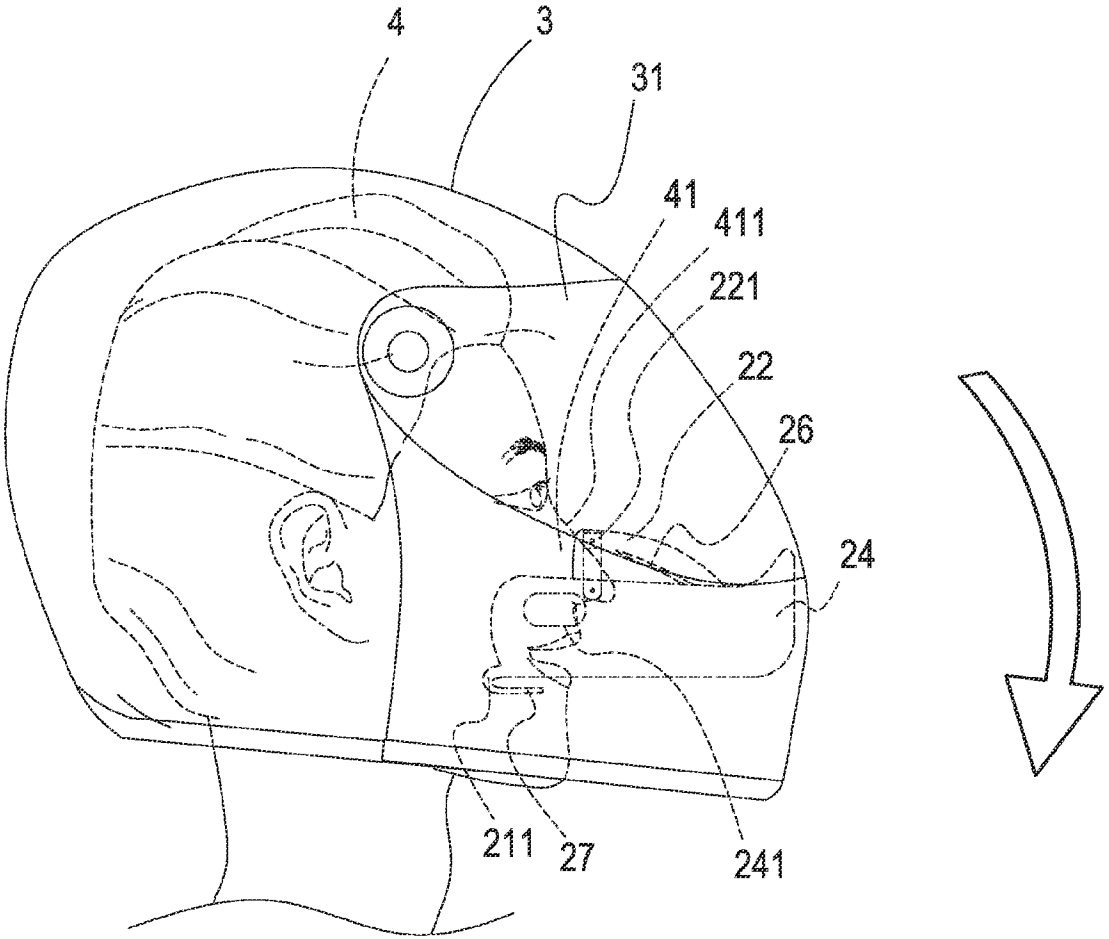
FIG. 6B illustrates a schematic application view of the improved nose-shielding device of the present invention.

With references to FIG. 5A, FIG. 5B, FIG. 6A, and FIG. 6B, which illustrate two schematic combining views of the improved is nose-shielding device and the helmet of the present invention and two schematic application views of the improved nose-shielding device of the present invention. As shown in FIG. 5A and FIG. 56, the positioning surface 24 has at least one positioning hole 241 so as to fix the positioning surface 24 of the nose-shielding body 2 onto the inner side surfaces of the helmet 3, and thus the nose-shielding body 2 is tightly adhered to the internal of the helmet 3 and located below a mask 31. According to figures, while an operator 4 wears the helmet 3, the face of the operator 4 touches the side edge 212 of the nose-shielding body 2, and the nose 41 is accommodated in the nose-shielding room 23, further that the bridge 411 of the nose 41 of the operator 4 fits the nose-touching portion 25, so that the touched position of the bridge 411 of the nose 41 of the operator 4 and the nose-touching portion 25 is completely sealed. When warm air 5 is discharged from the nose 41 of the operator 4, the nose-shielding surface 21, the nose-shielding portion 22 and the nose-touching portion 25 may block the upwardly moving warm air, hence the warm air 5 only goes down to avoid that the mask 31 of the helmet 3 is nebulized. Since the folded member 221 is able to position the nose-shielding portion 22 and the nose-touching portion 25 on the bridge 411 of the operator 4, and while the mask 31 is lifted up by the operator, as shown in FIG. 6A, the nose-shielding portion 22 and the nose-touching portion 25 move upwardly from the bridge 411 of the operator 4; on the other hand, the nose-shielding portion 22 and the nose-touching portion 25 may shield downwardly the nose 41 from the bridge 411 of the operator 4 is while the mask 31 moves downwardly, therefore the bridge 411 of the operator 4 totally fits on the nose-touching portion 25. Since the folded member 221 of the nose-shielding portion 22 makes one end of the nose-touching portion 25 to tightly stick on the bridge 411 of the operator 4, therefore no matter what the mask 31 moves up or down, the location of the nose-shielding portion 22 and the nose-touching portion 25 fitting the bridge 411 of the operator 4 will not be affected.

With the comparison to prior arts, the nose-shielding device for helmet has following advantages listed below:

1. The present invention is adjustable for the folding degree of the folded member according to the figure of the bridge of the operator nose, so that the nose-shielding portion of the nose-shielding body fits each operator.
2. The present invention adopts a single type of material for a uniform production process, and cost, time and labor can then be saved.

Although the invention has been disclosed and illustrated with reference to particular embodiments, the principles involved are susceptible for use in numerous other embodiments that will be apparent to persons skilled in the art. This invention is, therefore, to be limited only as indicated by the scope of the appended claims

What is claimed is:

1. An improved nose-shielding device for helmet comprising:

a nose-shielding body, which has a nose-shielding surface and a positioning surface that are about perpendicular to each other, a nose-shielding portion being located around the central of the nose-shielding surface) and protruded upward, a nose-shielding room being formed accordingly inside the nose-shielding portion, a nose-touching portion being formed at the bottom surface of the nose-shielding portion, an adjusting room being formed between the nose-touching portion and the bottom surface of the nose-shielding portion, the positioning surface of the nose-shielding body having at least one positioning hole in order to integrate the nose-shielding body into a helmet and locate the nose-shielding body under a mask, and characterized in that:

the nose-shielding portion has a flexible folded member that integrates with a portion, corresponding to the bridge of an operator nose, of the nose-shielding portion, and is adjustable for the folding degree of the folded member according to the figure of the bridge of the operator nose, thus the nose-shielding body more fits the operator nose.

2. The improved nose-shielding device for helmet according to claim 1, wherein the folded member integrates with the surface, corresponding to the bridge of the operator, of the nose-shielding portion by means of integrative shaping.

3. The improved nose-shielding device for helmet according to claim 1, wherein the folded member integrates with the inner surface, corresponding to the bridge of the operator, of the nose-shielding portion by means of integrative shaping.

4. The improved nose-shielding device for helmet according to claim 1, wherein the folded member integrates with the bottom surface, corresponding to the bridge of the operator, of the nose-shielding portion by means of integrative shaping.

5. The improved nose-shielding device for helmet according to claim 1, wherein the folded member is made of metal.

* * * * *